United States Patent [19]

Sherman

[11] 4,425,559

[45] Jan. 10, 1984

[54] METHOD AND APPARATUS FOR GENERATING LINE SEGMENTS AND POLYGONAL AREAS ON A RASTER-TYPE DISPLAY

[75] Inventor: David L. Sherman, Sunnyvale, Calif.

[73] Assignee: Atari, Inc., Sunnyvale, Calif.

[21] Appl. No.: 155,345

[22] Filed: Jun. 2, 1980

[51] Int. Cl.[3] ..... G09G 1/16

[52] U.S. Cl. ..... 340/747; 340/703; 340/750

[58] Field of Search ..... 340/703, 747, 748, 750

[56] References Cited

U.S. PATENT DOCUMENTS

| | | | |
|---|---|---|---|
| 3,480,943 | 11/1969 | Manber | 340/748 |
| 3,537,096 | 10/1970 | Hatfield | 340/725 |
| 3,925,776 | 12/1975 | Swallow | 340/324 |
| 3,944,997 | 3/1976 | Swallow | 340/747 |
| 4,182,053 | 1/1980 | Allen et al. | 340/725 |
| 4,199,815 | 4/1980 | Kyte et al. | 340/747 |
| 4,209,832 | 6/1980 | Gilham et al. | 340/725 |

*Primary Examiner*—Marshall M. Curtis

*Attorney, Agent, or Firm*—Townsend and Townsend

[57] ABSTRACT

A method and apparatus utilizes information describing linear line segments in terms (1) the horizontal scan line scan at which the line segment originates, (2) the horizontal position within the line of the point of origin, (3) the direction of the line segment, and (4) the horizontal scan line at which the line segment terminates to generate line segment information on a raster-scan type video display. The line segments can be combined to form polygonal areas that are capable of movement and changes in size or shape on the display.

11 Claims, 4 Drawing Figures

METHOD AND APPARATUS FOR GENERATING LINE SEGMENTS AND POLYGONAL AREAS ON A RASTER-TYPE DISPLAY

BACKGROUND OF THE INVENTION

The present invention pertains generally to the display of polygonal video images on a raster-scan display screen and more particularly to a method for generating the boundaries that are used to form the polygonal areas displayed.

The generation of line segments and, therefore, polygonal areas bounded by a number of such line segments, is easily accomplished by the vector generation technique. This technique draws straight lines by moving a cathode ray tube (CRT) beam continuously from a starting point to an ending point. By drawing a number of such straight lines end-to-end via this technique, a polygonal area is formed on the CRT. However, vector generation techniques cannot distinguish one polygonal area from another other than by size and shape.

Raster-type displays, that is, those utilizing an image-forming beam traversing a display screen in a plurality of horizontal lines, can add a further dimension to the display of polygonal areas. By appropriate control of the luminence and chroma information, the areas within the boundaries of any polygonal figure can be further distinguished from other polygonal figures by color or shading.

However, it has heretofore been the practice of generating polygonal areas on a raster-type display screen by storing a binary representation of the entire area in a random access memory (RAM). This binary information is read from the RAM in synchronism with the active scan of the display beam to display the polygonal area. If a number of such polygonal areas are to be generated, the memory space required can become exorbitant. Further, if the polygonal areas are to change in size or shape, the requirement for memory space increases accordingly, as does the circuitry required to handle these binary representations. A final disadvantage of this technique is that the handling of the required data is slow, leading to severe timing problems when the many different polygonal representations are to be displayed.

SUMMARY OF THE INVENTION

The method and apparatus of the present invention provides for generation of a number of polygonal areas to be displayed on a raster-type display screen by creating line segments that are used to form boundaries of the polygonal areas. Position data describing each line segment in terms of the position on the display screen of the line segment's point of origin and orientation are stored in a random-access-memory (RAM). During each display frame, the position data describing each line segment is accessed and used to determine the position on the display screen of the point of intersection between each line segment and each horizontal display line. These points of intersection, which define the line segment by forming a generally linear locus of elemental display points, are then used to store a predetermined control signal in an output RAM at a location corresponding to the position of the point of intersection (i.e., the elemental display points) on the display screen. During active display time of each horizontal line the output memory is read in synchronism with the display beam. As each control signal (defining a boundary point of the polygonal area) in the output memory is encountered, the chroma and luminence of the display beam is modified to provide a polygonal area with a distinguishing shade and color.

In the preferred embodiment, a microprocessor supplies binary information describing each line segment boundary of a polygonal area to be displayed. This binary information consists of five data words for each line segment, specifying: (1) the horizontal scan line of the raster in which the line segment begins (i.e., the vertical start point); (2) the horizontal position within the scan line at which the beginning of the line segment appears on the display screen; (3) the direction or slope of the line segment; (4) the horizontal scan line in which the line segment terminates (i.e., the vertical stop point); and (5) chroma and luminence information of the associated polygonal area.

During generation of each horizontal line, the binary information for each line segment is accessed from the position RAM and checked to determine if the line segment is to appear on the display screen during the next successive display scan line. If so, the data word containing chroma and luminance information is used as a control signal and is stored in the output RAM at a memory location corresponding to the position on the display screen of the intersection of the line segment (boundary) and next successive horizontal line. The line segment's horizontal position data word is modified so that it describes the position of the line segment in second successive horizontal line scan and the modified horizontal position returned to the memory location that originally held the unmodified horizontal position word. During the display scan of the next succeeding horizontal line, the memory locations of the output RAM are read in synchronism with the movement display beam. As each control signal is encountered and accessed, it is used to set the chroma and luminence of the beam until changed by the next encountered control signal. At the same time, the check and modification procedure described above is repeated to once again modify the horizontal data word.

A number of advantages are achieved by the method and apparatus of the present invention. First, the capability of generating a large variety of polygonal areas by a raster scan-type display technique is provided, each polygonal area capable of being distinguished from the other polygonal areas by shade and/or color.

Further, by providing a method and apparatus that accepts a minimum of information describing each line segment boundary of each polygonal area provides for the generation of a plurality of polygonal areas with a minimum required memory space. Additionally, this feature allows a user to modify the size and shape of any polygonal area with a minimum of effort and programming complexity by merely redefining each line segment boundary.

BRIEF DESCRIPTION OF THE DRAWINGS

For a more thorough understanding of the nature of the present invention, and how it may be best practiced by those skilled in the art, reference is made to the following detailed description and the appended figures in which.

DETAILED DESCRIPTION OF THE PREFERRED EMBODIMENT

Figure 1:
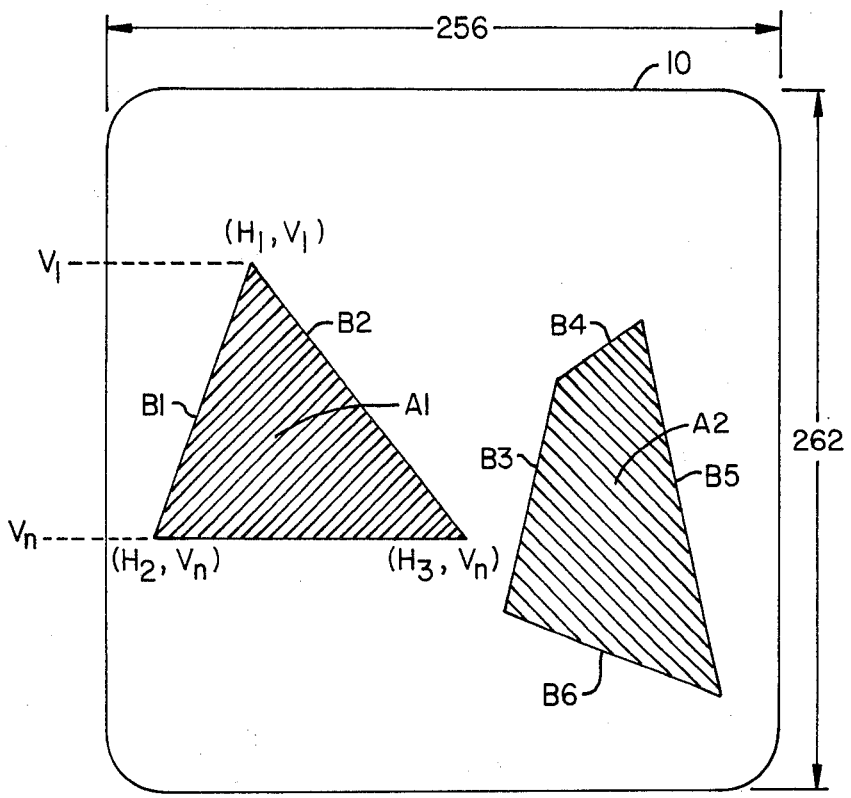
FIG. 1 is an illustrative view of a raster scan video display screen with a pair of polygonal areas displayed thereon.

FIG. 1 is an illustration of a video display screen, designated by the reference numeral 10, having video displayed thereon via a raster comprising 262 horizontal scan lines. In addition, video display screen 10 has 256 resolution elements for each horizontal scan line. As with most raster scan type displays, the electron beam used to paint the raster presented on the video display screen 10 begins at the upper lefthand corner and terminates at the lower right-hand corner, each horizontal line being drawn from left to right, the lines being drawn from top to bottom, as viewed in FIG. 1.

Accordingly, if the individual horizontal lines are numbered from top to bottom and each resolution element numbered from left to right, a Cartesian coordinate system can be described to pinpoint an elemental position on the display screen 10: A line number specifies the horizontal scan line containing the point and the horizontal position number specifies the relative position of the point within the line.

Returning to FIG. 1, the video display screen 10 is illustrated as having polygonal areas A1 and A2 appearing thereon. The polygonal area A1 is shown as being circumscribed or bounded by line segment boundaries B1 and B2 and a portion of horizontal scan line $V_n$ that extends from the point ($H_2$, $V_n$) to the elemental point ($H_3$, $V_n$). As FIG. 1 illustrates, both line segment boundaries B1 and B2 originate from the same elemental point ($H_1$, $V_1$), described by the horizontal scan line designated $V_1$ and the horizontal position $H_1$ within the scan line $V_1$. Similarly, both line segment boundaries B1 and B2 terminate in the same horizontal line, designated $V_n$. The line segment B1, however, terminates at the horizontal position $H_2$ within the horizontal line $V_n$, while the line segment boundary B2 terminates at the horizontal position $H_3$ within the horizontal line $V_n$. Thus, the polygonal area A1 utilizes a portion of one of the horizontal lines of the raster as one of the line segment boundaries.

It can be seen that the line segment boundaries for the polygonal area A1 are fully described using the coordinate point system to locate the elemental positions of their points of origin and termination on the display screen 10. The present invention uses a variation of the coordinate point system to describe the line segment boundary of each polygonal area to be displayed. The position on display screen 10 of the line segment boundary B1 can also be described by its point of origin ($H_1$, $V_1$), the scan line in which the line segment boundary terminates ($V_n$) and the direction or "slope" of the line segment boundary B1. As used herein, the slope of any line segment boundary is defined as the incremental change in horizontal position per vertical line, i.e., $\Delta H/\Delta V$. The sign of the $\Delta H/\Delta V$ element defines whether the (downward) direction of the line segment boundary is from left to right or from right to left—as viewed on display screen 10.

The polygonal area A2 illustrates a somewhat more complex configuration in that it is bounded by line segment boundaries B3, B4, B5 and B6. Each one of the line segment boundaries B3, B4, B5 and B6 can be described in the manner used to describe the line segment boundary B1; that is, each line segment boundary on display screen 10 is defined by the point of origin (H, V), the horizontal scan line in which the line segment boundary terminates (V) and slope ($\Delta H/\Delta V$).

As represented in FIG. 1, not only are the polygonal areas A1 and A2 differentiated from one another by size and shape, but also by chroma and luminance information, as illustrated by the cross hatching of each polygonal area.

The present invention, therefore, uses information in the form of data word groups that describe or identify each line segment boundary in terms of (1) the scan line at which the line segment boundary commences, (2) the horizontal position within the scan line at which the line segment boundary commences, (3) the line-per-line incremental horizontal change of the line segment boundary, and (4) the scan line at which the line segment boundary terminates.

The four data words that describe each line segment boundary also provide information for determining each elemental resolution element forming the locus of the line segment boundary. For example, with reference to FIG. 2 which is an illustration of a portion of the display screen 10 having the apex of the polygonal area A1 appearing thereon, assume that the slope ($\Delta H/\Delta V$) of the line segment boundary B1 is $-\Delta B1$. As noted above, the point of origin of the line segment boundary B1 is in the scan line $V_1$ at horizontal position $H_1$. The next elemental point would be in line $V_2$ at horizontal position $H_1+(-\Delta B1)=H_1-\Delta B1$. Similarly, the point in scan line $V_3$ would be $(H_2+(-\Delta B1))=H_1-2\Delta B1$; and the point in scan line $V_i$ would be $H_1+(i-1)(-\Delta B1)=H_1-(i-1)\Delta B1$. Similarly, if the slope of the line segment boundary B2 is $\Delta B2$, the horizontal position of each elemental element forming the locus of the line segment would be $H_1+(i-1)\Delta B2$ (i taking on the values of 1 through n) for lines $V_2$ to $V_n$.

Figure 3A:
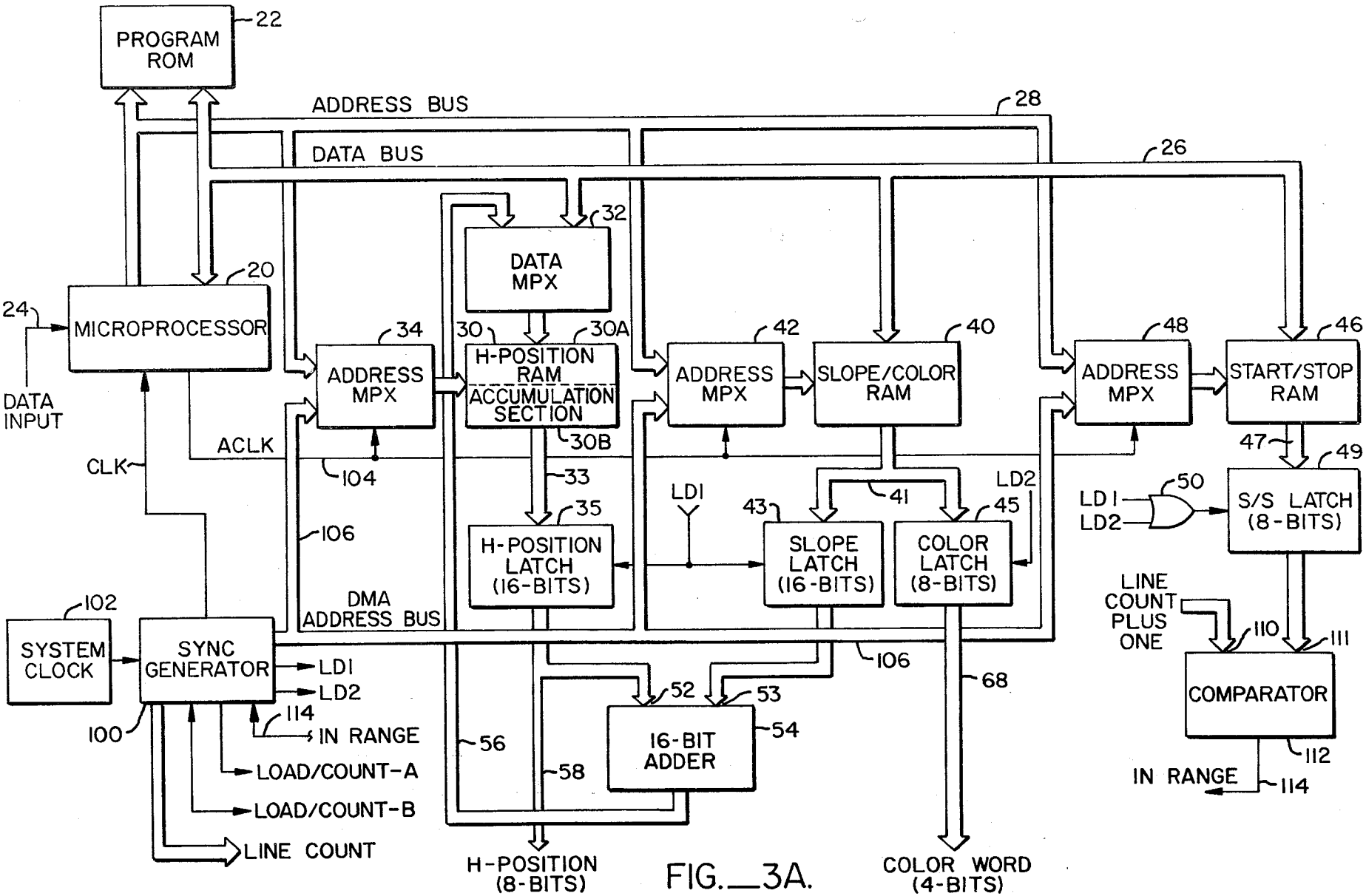
FIGS. 3A and 3B are the block diagram schematic of the electronic logic embodying the present invention.
Figure 3B:
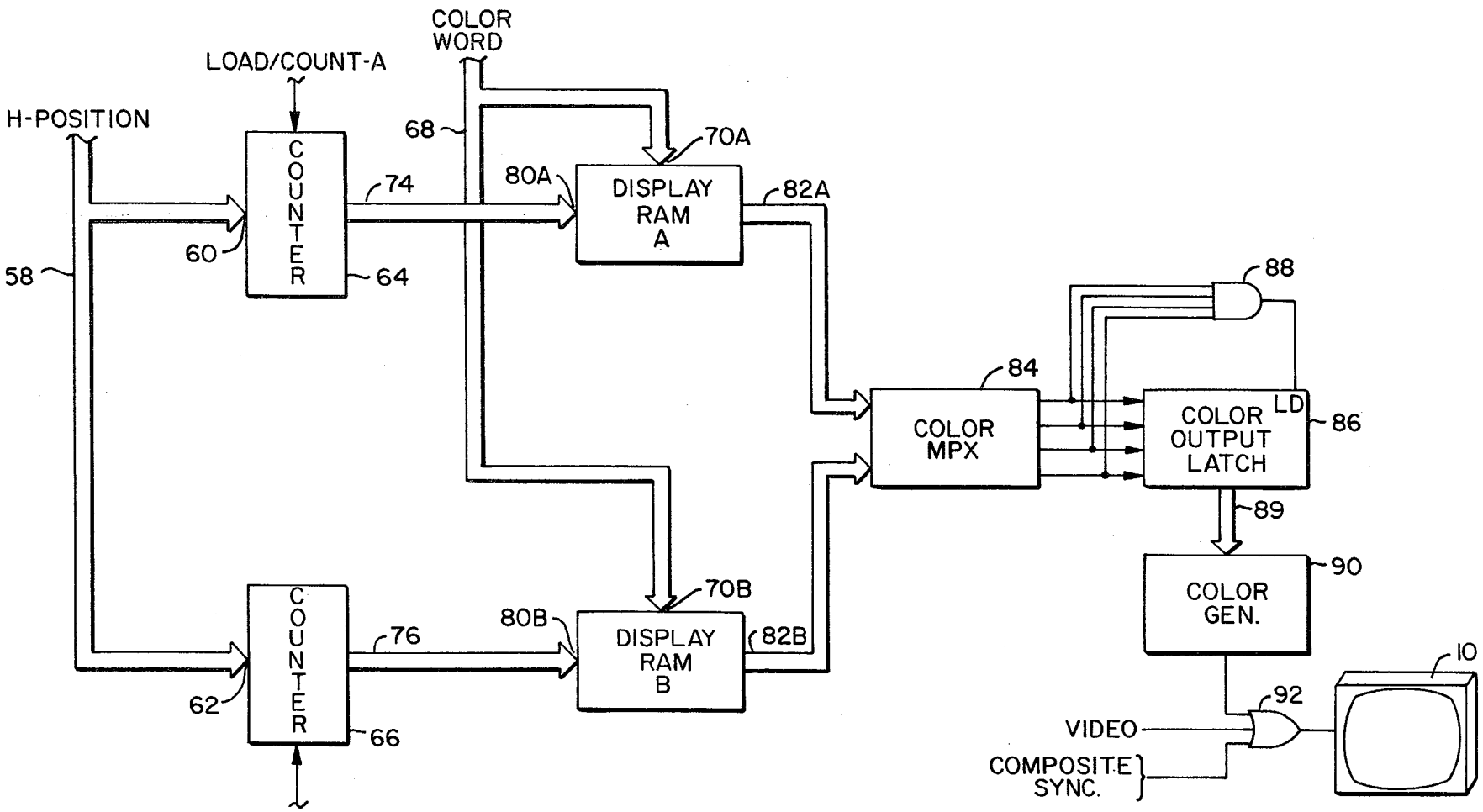

Turning now to FIGS. 3A and 3B, there is illustrated in block diagram form the electronic logic circuitry used to practice the present invention. As illustrated, a microprocessor 20 operates in accordance with instructions sequentially accessed from a program RAM 22 in accordance with conventional methods. The microprocessor 20 receives on a data input terminal 24 information calling for one or more polygonal areas to be displayed on the display screen 10. The data input terminal 24 could receive information from, for example, the manual controls (not shown) of a video amusement game in which the display screen 10 and the accompanying circuitry shown in FIGS. 3A and 3B are incorporated.

From the data signals received on the data input terminal 24, the microprocessor 20 formulates binary information describing the polygonal areas to be displayed on the display screen 10 in terms of data word groups, each group describing a line segment boundary used to form the polygonal area.

Each data word group contains five data words: two 8-bit data words respectively identify the horizontal scan lines at which the line segment boundary originates and terminates; a 16-bit data word defines the horizontal position within the horizontal scan line at which the line boundary segment originates; a 16-bit data word describes the slope (i.e., the $\Delta H/\Delta V$) of the line segment boundary; and a 4-bit data word containing color and luminance information.

The data words are communicated to various random-access-memories (RAMs) via a data bus 26 and stored at memory location in the respective RAMs at addresses defined by address signals communicated via an address bus 28. The 16-bit horizontal position data word is communicated to a horizontal position RAM 30 via a data multiplex circuit 32 and stored in a memory location located in a H-position section 30A of the horizontal position RAM 30. The address of the location at which each horizontal position data word is stored is conducted on the address bus 28 to the horizontal position RAM 32 via an address multiplex circuit 34. For reasons that will become evident below, the horizontal position data words are initially stored in the H-position section 32A of the horizontal position RAM 32 and are subsequently transferred to the accumulator section 32B of the horizontal position RAM 32 by a direct memory access (DMA) process.

The slope ($\Delta H/\Delta V$) and color/luminance data words for each line segment boundary are conducted from the microprocessor 20 by the data bus 26 to a slope/color RAM 40. Address signals for locating the particular memory location in the slope/color RAM 40 are communicated thereto from the address bus 28 via an address multiplex circuit 42.

The 8-bit data words containing the information that describe the horizontal scan lines at which a line segment boundary originates and terminates are sequentially stored in 2 byte pairs in the start/stop RAM 46.

The data outputs of each of the RAMs 30, 40 and 46 are coupled to latches which are used to temporarily hold data words read from the respective RAMs during operation thereon. Thus, the data output lines 33 are coupled to a 16 bit H-position latch 35; the output data word lines 41 of the slope/color RAM 40 are coupled to a 16 bit slope latch 43, while 4 (the low order data bits) of the data lines 41 are also coupled to a 4-bit COLOR latch 45; and the data output lines 47 of the start/stop RAM 46 are coupled to an 8 bit S/S latch 49.

The content of the H-position latch 35 and the slope latch 43 are applied to the respective input terminals 52 and 53 of a 16-bit adder 54, combined by the adder 54, the result being returned to the horizontal position RAM 30 (actually, as will be seen, to the accumulation section 30A) by the output lines 56 and data multiplex circuit 32.

Eight bits of the content of the H-position latch 35 (the high-order eight bits) are conducted by the signal lines 58 to the preset inputs 60, 62 of counters 64 and 66, respectively (FIG. 3B) and used to preset the counters 64 and 66. Similarly, the output lines 68 of the color latch 45 communicate the 4-bits of color/luminance information to the data inputs 70A and 70B of color display RAMs A and B, respectively.

The output signal lines 74 and 76 of the counters 64 and 66, respectively, carry count signals which are applied to the respective inputs 80A and 80B of address circuits of color display RAMs A and B. The data output lines 82A and 82B of the color display RAMs A and B, respectively, are selectively multiplexed by a color multiplex circuit 84, the selected output lines 82A or 82B then being communicated to a color output latch 86, as well as AND gate 88. The output of the AND gate 88 is communicated to the load (LD) input of the color output latch 86 and effectively causes loading of the color output latch 86 with whatever is applied thereto from the color multiplex circuit 84 when not all binary "1s".

The output lines 89 of the color output latch are coupled to a chroma generator 90 where the binary information is converted to chroma and luminance information that is then applied to a video adder unit 92 and combined with composite sync and other video signals.

Timing and control signals which govern information selection and transfer within the system of FIGS. 3A and 3B are generated by the sync generator 100. The sync generator 100 receives a 12 MHz clock signal from a system clock 102 to drive horizontal and vertical synchronization counters (not shown) of conventional design to produce various timing and synchronizing pulses used throughout the system for loading various of the latches and counters, as will be seen below. Thus, for example, a clock (CLK) signal is communicated to the microprocessor 20 to provide synchronous operation of the circuitry therein. In turn, the microprocessor 20 produces a symmetrical square (ACLK) signal that is communicated to the address multiplex circuits 34, 42 and 48 of the respective RAMs 32, 40 and 46 via signal line 104. The ACLK signal has substantially the same frequency and form as the CLK signal, the ACLK signal differing from the CLK signal only by a delay (phase shift) of approximately 20–60 nanoseconds.

The ACLK signal functions to operate the respective address multiplex circuits 34, 42 and 48, interleaving communication of (1) address signals provided by the microprocessor 20 via the address bus 28 and (2) DMA address signals that are derived from predetermined counts produced by the synchronization counters of the sync generator 100. The DMA address signals provided by the sync generator 100 are communicated via the DMA address bus 106 to the respective address multiplex circuits. The address signals communicated on the DMA address bus 106 provide direct memory access to information contained in, for example, the horizontal position RAM 30.

Access to the RAM 30, 40 and 46 is given to the DMA address signal produced by the sync generator 100 during one of the two phases of the ACLK signal, which selects the DMA address bus 106 for communication to the address circuits of the RAMs. During this one phase of the ACLK signal, the address signals generated by the microprocessor 10 are inhibited by the address multiplex circuits 34, 42 and 48 associated with the respective RAMs 30, 40 and 46. During the second of the two phases of the ACLK signal, however, the address signals conducted on the address bus 28 are applied to the RAMs 30, 40, and 46 via the respective address multiplex circuit 34, 42 and 48. In actual practice, the address multiplex circuits 34, 42 and 48 are combined as one signal multiplex unit. These separate multiplex circuits are illustrated here for ease in explaining the present invention.

The sync generator 100 also provides, in synchronism with the DMA address signals, a load (LD1) signal that causes the H-position and slope latches to accept and temporarily store data from RAMs 30 and 40; another load (LD2) signal causes the color latch 45 to store information. Both the LD1 and LD2 signals are communicated to the S/S latch 49 via the OR gate 50 to cause S/S latch 49 to accept and store information.

Finally, the sync generator 100 also produces a LINE COUNT signal that indicates the line number representative of the particular horizontal scan line presently being produced on the display unit 10. The LINE COUNT signal is applied to the input terminal 110 of a comparator 112 in a manner that causes the LINE COUNT signal (plus a binary "one") to be compared to the content of the S/S latch 49, the latter being applied to the input terminals 111 of the comparator 112. When a match is obtained by the comparator 112, that is, when the line number, plus one, of the particular horizontal line being scanned matches the content of the S/S latch 49, the comparator 112 issues an IN RANGE signal that is conducted to the sync generator 100 on signal line 114. Receipt of the IN RANGE signal by the sync generator 100 will cause it, in turn, to provide a load pulse on either the LOAD/COUNT A or LOAD/-COUNT B signal lines that are applied to the binary counters 64, 66, respectively.

In operation, the microprocessor 20 will periodically receive information on the data input 24 relating to one or more of the polygonal areas to be generated such as, for example, the polygonal areas A1 and A2 shown in FIG. 1. The microprocessor 20, for each polygonal area, will formulate the data words that describe the line segment boundaries B1–B6 and communicate the data words to the RAMs 30, 40 and 46 where they are stored until used to form the polygonal areas A1 and A2 on the display screen 10. Thus, data words containing the horizontal position within the scan line of the origin of each line segment boundary are conducted to the H-position RAM 30 and stored in the H-position portion 32A thereof (during the phase of the ACLK signal allocated to the microprocessor 20 for memory access). Similarly, the data words describing the slope of the respective line segment boundaries are conducted to and stored in predetermined memory locations of the slope/color RAM 40. The memory location of the slope/color RAM 40 containing the slope data word for each line segment boundary is immediately followed by the data word describing the color and luminance of that portion of the line scan used to represent the line segment boundary itself, as well as that portion of the scan line immediately to the right of the line segment boundary (as viewed in FIG. 1) up to the next line segment boundary. Finally, the data words that describe the horizontal line of origination of the line segment boundary and the horizontal line of termination of the line segment boundary (i.e. "start" and "stop" lines) are stored in the start/stop RAM 46.

During the vertical retrace (blanking) interval, the horizontal position information stored in section 32A of the position RAM 32 is shifted to the accumulator section 32B under the control of the DMA address (and read/write) signals generated by the sync generator 100. As will be seen hereinafter, the data word describing the horizontal position within the line scan for each line segment boundary is updated during each horizontal line scan. This update consists of adding to the horizontal position (H) the slope ($\Delta H/\Delta V$) to produce the update horizontal position ($H+\Delta H/\Delta V$), which is then stored at the memory location that contained (H). Accordingly, the updated data word is kept in the accumulator section 32B, separate from the original horizontal position word in order to preserve the horizontal position of the point of origin for each line segment boundary (which is retained in the section 32A of the H-position RAM 30).

The time period used to make up each horizontal line scan is divided into a predetermined number of time slots, each time slot being allocated to a line segment boundary. During each time slot, the data words containing the line segment information are read from their respective storage locations and used to determine if the line segment boundary is to be displayed; if so, one of the display RAMs A and B is loaded with indicia for displaying the line segment boundary in the next upcoming horizontal line scan. A specific example will make this operation clearer.

Figure 2:
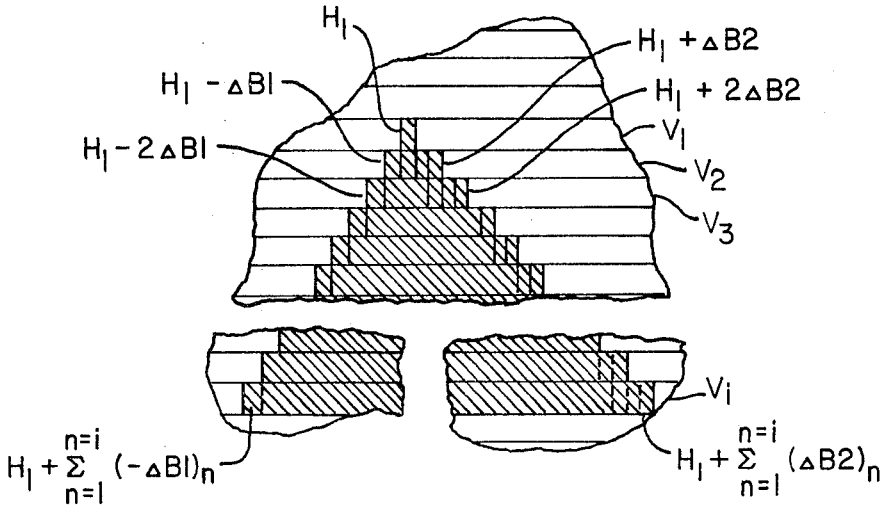
FIG. 2 is an enlargement of a portion of the display screen of FIG. 1 illustrating in greater detail a portion of one of the polygonal areas.

Assume that the first time slot of each horizontal line scan period is allocated to the line segment boundary B1 (FIGS. 1 and 2). Succeeding time slots are allocated to the line segment boundaries B2–B6. During each horizontal line scan, addressing signals (accompanied by the appropriate read/write signals) are provided by the sync generator 100 and applied to the DMA address bus 106 to read the data words describing the line segment boundaries to be displayed. Thus, the memory location of the accumulator section 30B of the horizontal position RAM 30 is addressed to read the data word containing, for example $H_1$-corresponding to line segment boundary B1. The memory locations of the slope/color and start/stop RAMs 40 and 46 are also read to obtain the slope ($-\Delta B1$) and the line number ($V_1$) at which the line segment boundary B1 originates. Simultaneous with the read operation, the sync generator 100 issues a pulse on the LD1 signal line to load the H-position, slope and S/S latches 35, 43 and 49.

The content of the S/S latch 49 is compared, by the comparator 12, to the line count corresponding to the next succeeding horizontal line to be scanned by the display unit 10—that is, the present line count plus one. If the content of the S/S latch 49 is less than the line count describing the next succeeding horizontal line (i.e., line count plus one), the IN RANGE signal line of the comparator 112 remains inactive and nothing more is done during the time slot allocated to the line segment boundary B1. This condition occurs during horizontal line scans that are vertically above the line scan corresponding to $V_1$ as viewed in FIG. 1, except for the horizontal line scan having a line count equal to $V_1-1$.

If, on the other hand, a match is obtained, that is, the line count plus one is equal to or greater than the content of the S/S latch 49 (i.e., $V_1$), the comparator 112 will so indicate by applying an IN RANGE signal to the IN RANGE signal line 114.

The IN RANGE signal is conducted to the sync generator 114. Assume, for example, that the present horizontal line scan has a line count number of $V_1-1$. When this number is compared with the content of the S/S latch 49, an IN RANGE signal is conducted on the signal line 114 from the comparator 112 to the sync generator 100. The sync generator 100 will then issue a WRITE signal that is conducted to the horizontal position RAM 30 via the DMA address bus 106 and address multiplex circuit 34. The address signals on the DMA address bus 106 remain unchanged. This will cause the result of the operation performed by the 16-bit adder 54 to be written into the memory location of the accumulator section 30B of the horizontal position RAM 30 that previously contain the $H_1$ data word; that is, the memory location will now contain a 16-bit data word that is the sum of $H_1$ and the slope of the line segment boundary B1 ($-\Delta B1$) or $H_1-\Delta B1$.

The sync generator 100 then updates the address signals applied to the DMA address bus 106 to address the data words containing color and the termination line information in RAMs 40 and 46, respectively, for the line segment boundary B1. At the same time a pulse is issued on the LD2 signal line by the sync generator 100 to load the information appearing on the output signal lines of the RAMs 40 and 46 into the color and S/S latch 49. Once again the content of the S/S latch 49 is compared to the line count plus one by the comparator 112. If the content of the S/S latch 49 is greater than or equal to the line count plus one, the IN RANGE signal line 114 will become inactive. In our example, however, the content of the S/S latch 49 will be less than the line count plus one so that an IN RANGE signal will be conducted to the sync generator 100.

During this particular horizontal line scan, the sync generator 100 has held the LOAD/COUNT-A signal line in a load state. This places the counter 64 (FIG. 3B) in a continuous load condition so that it acts as a mere conduit for the signals appearing on signal lines 58. Thus, the high order 8 bits of the content of the H-position latch 35 are applied to the address circuits 80A of the display RAM A. At the same time, a write signal is generated by the sync generator 100 and transmitted to the display RAM A to cause the content of the color latch 45 to be written into the memory location of the display RAM A designated by the address signals communicated on the signal lines 58, through counter 64, to signal lines 74. The 4-bit data word containing color information associated with the line segment boundary B1 is, therefore, written into a memory location of the display RAM A at a horizontal position corresponding to the horizontal position on the display screen 10 of the next upcoming line scan at which the line segment boundary B1 will appear.

With the loading of the color information associated with the line segment boundary B1 into the display RAM A the time slot period for the line segment boundary B1 ends. The same procedure for the remaining line segment boundaries (line segment boundaries B2–B6, for example) are processed in the same manner in the present horizontal line scan (i.e., the horizontal line scan identified by the line count number $V_1-1$).

During each vertical retrace interval, all memory locations of the display RAM A (and the display RAM B) have been previously written to contain all "1s". At the end of the present horizontal line, after processing all line segment boundary lines that are to be displayed in the next upcoming horizontal line scan, the display RAM A will contain a 4-bit code (i.e., the color information) other than all "1s" only at those memory locations corresponding to the horizontal position within the next upcoming line at which the line segment boundaries are to appear. The reasons for this will become evident below.

At the start of the next upcoming horizontal line scan (line count $V_1$), the counter 64 is cleared. The sync generator 100 then commences, in synchronism with the beam scan on the video display screen 10, to issue count pulses that are communicated to the counter via the LOAD/COUNT-A signal line and communicates read signals to the display RAM A. In this manner, the sequential memory locations of the display RAM A are read and applied to the color multiplex circuit 84 via the display RAM A data line 82A. The color multiplex circuit 84, during this time, is set to a condition that selects the output lines 82A for application to the color output latch 86 by the sync generator 100. Also at the outset of the present line scan, the color output latch 86 is set to contain all "1s". The all "1s" condition will cause the color generator 90 to produce general background color/luminance on the display screen 10.

As the display RAM A is sequentially read, the various 4-bit data words containing color information associated with the line segment boundaries B1–B6 are encountered and applied in parallel to the input circuits of the color output latch 86 and the AND gate 88. Since the 4-bit word is something other than all "1s", the output of the AND gate 88 will become a binary "0", which in turn loads the color output latch 86 with the data word applied to the input circuits thereof. The color output latch 86 will continue to contain this data word while the display RAM A is sequentially read until another data word, not all "1s", is read.

When each memory location of the display RAM A containing the color information data word is encountered, the read operation is immediately followed by a write operation. An all "1s" data word is then written into the memory location that contained the color information data word just read.

The data word content of the output latch 86 is applied via the data lines 88 to the color generator 90 which selects a cclor/luminance value dictated by the data word. The selected color/luminance value is communicated to the video display screen 10 via the video adder 92 to cause the beam scan to paint a color/luminance display indicative of background or the color/luminance of the particular polygonal area being displayed, such as, for example, the polygonal area A1. Thus, for example, referring to FIG. 2, during the horizontal line scan $V_3$, the horizontal position $H_1-2\Delta B1$ will be reached by the scanning beam. At the same time, the counter 64 will produce address signals on the counter output lines 74 that address the memory location of display RAM A containing the color data word associated with the line segment boundary B1. The color data word will be accessed and temporarily stored in the color output latch 86 to, in turn, via the color generator 90, cause the scanning beam to take on the color/luminance value indicated. The scanning beam will remain at the indicated color/luminance value until the horizontal position in the scanning line $V_3$ for the line segment boundary B2 (i.e., indicated as $H_1+2\Delta B2$); the color output latch 86 is then loaded with a data word containing color/luminance information that returns the scanning beam to the background color/luminance state.

During this sequential reading of the display RAM A and generation of the horizontal line scan associated therewith, the counter 66 has been held in a continuing load condition by the sync generator 100; and the line segment boundaries B1–B6 have been processed in the manner described above to cause color information to be stored in the display RAM B. Thus, while one of the display RAMs A and B is being written with color information for the next upcoming horizontal line, the other of the display RAMs A and B is being read in synchronism with the scanning beam.

As each memory location of the respective display RAM A or B containing information other than all "1s", that memory location is clear to all "1s" so that at the end of the line scan in which the particular display RAM was read, the RAM will again contain all "1s" in every memory location. Thereby, the RAM in question is prepared.

It is apparent from the foregoing that a new and improved method and system for producing polygonal areas and line segments have been provided. While only certain presently preferred embodiments have been described, as will be apparent to those familiar with the art, certain changes and modifications can be made without departing from the scope of the invention as defined by the following claims.

I claim:

1. Apparatus for generating a plurality of individually, selectively orientable line segments on a video raster scan-type display screen scanned in successive frames by an image-forming beam traversing the screen along a plurality of horizontal lines, each line segment being formed by a generally linear locus of elemental points emanating from an initial elemental point defining an end of the line segment, each line segment being described by position data indicative of the location on the display screen of the initial elemental point of the line segment and direction data indicative of the incremental line-to-line change in horizontal position on the display screen of the line segment, the apparatus comprising:

first memory means for storing the position data and the direction data for each of the line segments;

means coupled to the first memory means for receiving said position data and said direction data for each line segment and for calculating therefrom a plurality of sums each corresponding to the horizontal position of each elemental point of each line segment;

means for providing a data word corresponding to each line segment indicative to the luminance of the line segment on the display screen;

second memory means coupled to said calculating means and the providing means and responsive to the calculated sums corresponding to each elemental point for storing the data word at memory locations corresponding to the position of the elemental point on the display screen; and means for sequentially scanning said second memory means in synchronism with said beam scan for delivering an output display signal when the position of the beam corresponds to the memory location containing the data word of said line segment point.

2. The apparatus of claim 1, wherein said second memory means comprises at least a pair of random-access-memory elements, and means for alternately storing and scanning the random-access-memory elements during scans of alternate horizontal lines.

3. The apparatus of claim 1, wherein the data word providing means includes a microprocessor means coupled to the first memory means for providing the position data and the direction data thereto.

4. The apparatus of claim 1, wherein the data word corresponding to each line segment includes information indicative of color of the line segment.

5. A method for generating a polygonal area on a video raster scan display screen scanned in successive frames by an image-forming beam traversing the screen along a plurality of horizontal scan lines, the polygonal area being bounded by at least a pair of spaced, line segments, each line segment being described by data indicative of at least (1) the location at which a starting point of the line segment is to be displayed on the display screen and (2) a horizontal line-to-line change of the line segment, the method comprising the following steps:

storing said line segment description data in a first memory element;

for each line segment:

accessing said location data and said line-to-line change data;

incrementing said location data with said line-to-line change data to form a number of sums indicative of a location on the display screen of a corresponding number of display points, the display points, when displayed, forming a generally linear locus on the display screen defining the corresponding line segment;

storing for each sum a control signal in a second memory element at a memory location designated by said each sum and corresponding to the position on the display screen at which the display point will appear; and scanning the second memory element in synchronism with the electron beam to obtain said control signals.

6. The method of claim 5, wherein the control signal for each line segment includes color information, and wherein the scanning step is followed by the step of latching each control signal obtained from the second memory element to form therefrom a video signal having a color value indicative of the color information included in the latched control signal.

7. The method of claim 5, wherein the scanning step is followed by the step of forming from each of the control signals a video signal indicative of the corresponding line segments.

8. The method of claim 5, wherein the scanning step is followed by the step of forming from each of the control signals a video signal indicative of the color and luminance that will be displayed by each horizontal scan line adjacent each corresponding display element.

9. A method of forming a polygonal area having a selective size and shape, the polygonal area being circumscribed by a boundary defined by a number of line segments each formed from a generally linear locus of elemental display points displayed on a video display screen of the type utilizing a raster of scan lines formed from an image-forming beam, the method comprising:

storing, for each line segment, position data indicative of the location on the display screen at which an initial display point defining an end of the line segment, slope data indicative of the orientation on the display screen of the line segment, and control data indicative of the color and luminance produced on the display screen proximate the line segment;

during each scan line, and for each line segment, accessing the position data to produce therefrom an in-range signal indicative that a display point of the corresponding line segment will be displayed in the next succeeding scan line;

in response to the in-range signal:

accessing the slope data and the control data for each line segment;

incrementing the position data with the slope data to produce therefrom an address signal indicative of the horizontal location on the display screen at which the display point corresponding to the line segment will be displayed in said next succeeding line scan;

storing the control word in a second memory element at a memory location defined by the address signal;

scanning the second memory element in synchronism with said electron beam.

10. Apparatus for generating a selectively orientable line segment displayed on a video display screen of the type scanned by an electron beam forming a plurality of horizontal image-forming scan lines, the line segment being formed by a generally linear locus of individual display elements that originate from an initial display element, the apparatus comprising:

first memory means for storing a data word group corresponding to the line segment, each data word group including a horizontal data word and a vertical data word identifying a location on the video display screen at which the initial display element is to be displayed and an orientation data word of the line segment in the form of an incremental line-by-line change in horizontal position on the video display screen of the linear locus;

combining means coupled to the memory means for receiving and sequentially incrementing the horizontal data word describing the horizontal locations and the orientation data words to form therefrom a plurality of address words each indicative of a horizontal location on the display screen at which a corresponding one of the individual display elements will be displayed;

second memory means coupled to the combining means and responsive to the address words for storing a control signal indicative of each corresponding individual display element at a memory location corresponding to the location on the display screen at which each elemental display element will be displayed; and accessing means coupled to the second memory means for sequentially scanning said second memory means in synchronism with the electron beam to access the control signal for each corresponding display element.

11. Apparatus for generating a variable-shaped polygonal area on a video display screen of the type having an image-generating electron beam forming a raster of horizontal scan lines in response to predetermined timing signals, the polygonal area being constructed from a plurality of circumscribing line segments formed from a generally linear locus of display elements beginning with an initial display element, the apparatus comprising:

first memory means for storing a data word group for each of the line segments, the data word group including information indicative of horizontal and vertical locations at which the initial display element will be displayed and the orientation of the linear locus of display elements in the form of a horizontal line-by-line change of the line segment;

accumulator means coupled to the first memory means for receiving and storing the horizontal location information for each initial display element as an updated data word;

compare means responsive to the timing signals for receiving the vertical location information of each line segment to generate therefrom an in-range signal indicating that a display element of the line segment is to be displayed in a next horizontal line scan;

combining means coupled to the first memory means and to the accumulator means, and responsive to the in-range signal, for accessing the updated data word and the orientation information for each line segment to form therefrom a sum data word;

means coupled to the accumulator and combining means for causing the sum data word to be stored in the accumulator means as the updated data word;

second memory means coupled to the combining means and responsive to the sum data word for storing a control signal at a location corresponding to the location at which the display element will be shown on the display; and means responsive to the timing signals for accessing the second memory means in synchronism with the electron beam.

* * * * *